United States Patent [19]

Lancaster

[11] Patent Number: 4,549,388

[45] Date of Patent: Oct. 29, 1985

[54] PACKAGE SEALING APPARATUS

[75] Inventor: William G. Lancaster, Louisville, Ky.

[73] Assignee: Lantech, Inc., Louisville, Ky.

[21] Appl. No.: 531,768

[22] Filed: Sep. 13, 1983

[51] Int. Cl.[4] ..... B65B 11/32; B65B 53/00; B65B 51/14

[52] U.S. Cl. ..... 53/556; 53/210; 53/588; 53/379

[58] Field of Search ..... 53/556, 379, 138 A, 53/373, 588, 210; 156/580.2, 543, 583.1

[56] References Cited

U.S. PATENT DOCUMENTS

| | | | |
|---|---|---|---|
| 603,585 | 5/1898 | Crowell . | |
| 1,417,591 | 5/1922 | Anderson . | |
| 2,575,467 | 5/1946 | Riechel et al. . | |
| 2,863,270 | 12/1958 | Elmer . | |
| 3,000,167 | 9/1961 | Pierce . | |
| 3,050,916 | 8/1962 | Gausman et al. | 53/379 X |
| 3,514,920 | 6/1970 | Hoffler et al. . | |
| 3,590,549 | 7/1971 | Zelnick . | |
| 3,626,654 | 12/1971 | Hoffler et al. . | |
| 3,640,048 | 2/1972 | Zelnick et al. . | |
| 3,673,041 | 6/1972 | Schulz et al. | 53/373 X |
| 3,679,509 | 7/1972 | Fielibert | 53/373 X |
| 3,793,798 | 2/1974 | Lancaster et al. . | |
| 3,867,806 | 2/1975 | Lancaster et al. . | |
| 3,942,302 | 3/1976 | Bloom | 53/138 A |
| 4,050,220 | 9/1977 | Lancaster et al. | 53/556 |
| 4,067,175 | 1/1978 | Vinokur | 53/373 |
| 4,075,818 | 2/1978 | Wright et al. | 53/373 X |
| 4,110,957 | 9/1978 | Lancaster et al. . | |
| 4,159,220 | 6/1979 | Bosche et al. | 53/373 X |
| 4,178,734 | 12/1979 | Lancaster et al. . | |
| 4,288,968 | 9/1981 | Seko et al. | 53/373 X |
| 4,302,920 | 12/1981 | Lancaster et al. | 53/556 X |
| 4,317,322 | 3/1982 | Lancaster et al. | 53/556 X |

*Primary Examiner*—Horace M. Culver
*Attorney, Agent, or Firm*—Gipple & Hale

[57] ABSTRACT

The invention comprises a novel apparatus for making unitary completely wrapped packages. In the apparatus, a series of loads are fed into a wrapping apparatus onto a wrapping conveyor assembly comprised of a plurality of conveyors. The film is continuously wrapped around the load and the conveyor assembly to form a spiral bundle with the load being carried off by the top portion of one conveyor and the wrap being carried off the bottom portion of another conveyor so that the load and wrap are carried off at the same speed onto a take-off conveyor. The spiral stretched film web is sealed and severed between adjacent loads by a cutting and sealing apparatus to form a six sided compressive wrap around each load.

23 Claims, 17 Drawing Figures

Fig 5
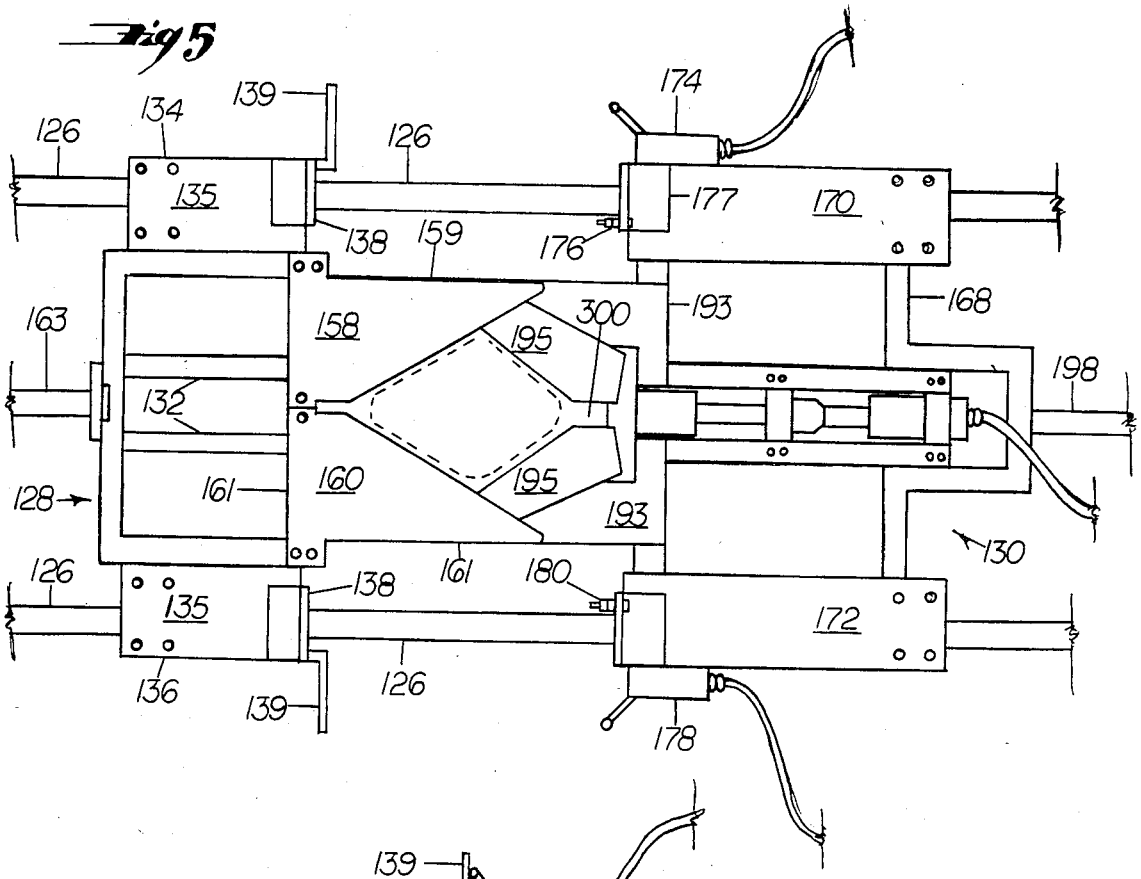
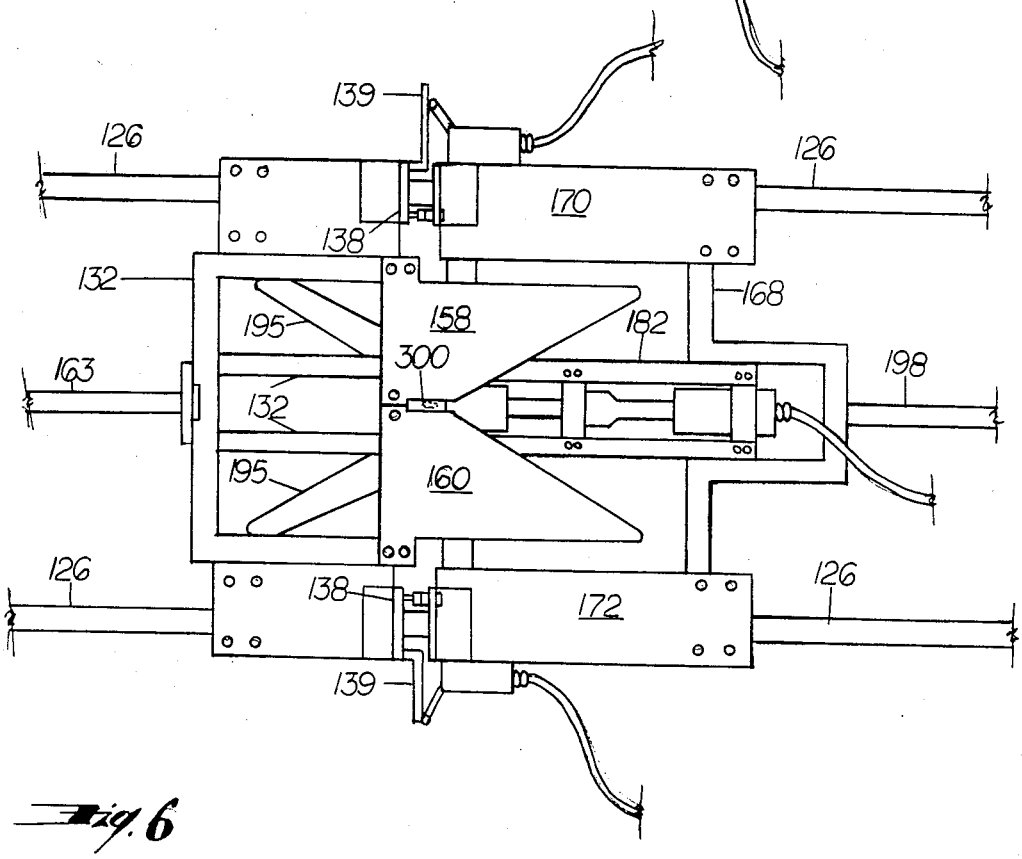
Fig. 6

Fig. 11
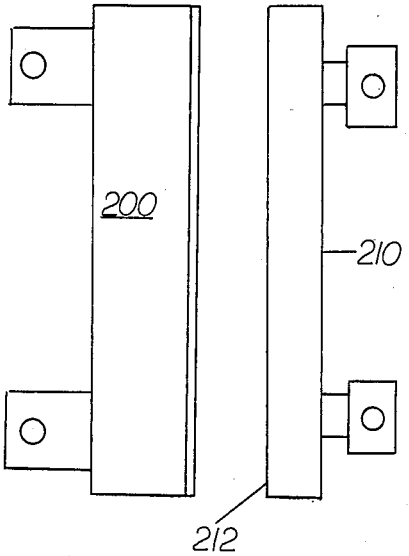
Fig. 12
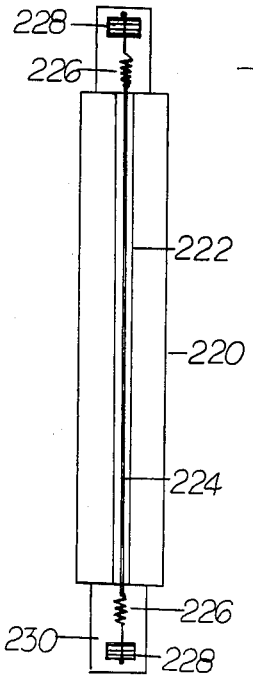
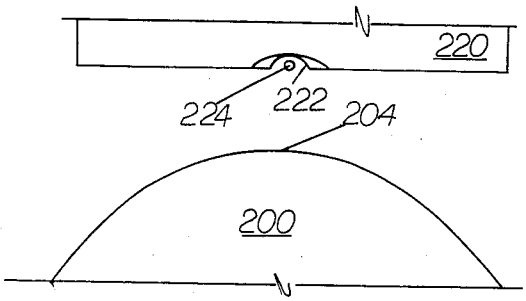
Fig. 13
Fig. 14
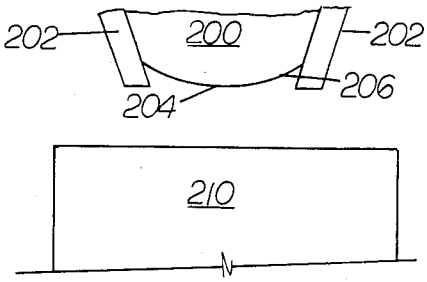

PACKAGE SEALING APPARATUS

BACKGROUND OF THE INVENTION

The present invention generally relates to packaging and more particularly is directed to an apparatus for making unitary packages wrapped on all sides which hold a plurality of components, each package containing a load wrapped and enclosed by stretched film.

Case packing or boxing is a common way of shipping multiple unit products so that the products are encased on all sides. Multiple unit products are generally stacked in a corrugated box or are wrapped with draft paper with the ends of the draft paper being glued or taped.

Customer dissatisfaction with gluing is high because removal of glued cartons or bags from the unitized loads tends to tear the outside layers of the cartons. Glue, although an inexpensive material, demands interleaving for product orientation requiring more durable and expensive packaging material.

Alternatively, tape is used to horizontally bind the top layer of the load. However, tape is expensive and allows relatively free movement of all product surrounded.

Another way of packaging contained products is by putting a sleeve or covering of heat shrinkable material around the load, placing a bottom and top cover on the load and shrinking the sleeve and covers to form a unitized enclosed package. The use of heat shrinkable film is described in U.S. Pat. Nos. 3,793,798; 3,626,654; 3,590,549; and 3,514,920. A discussion of this art is set forth in U.S. Pat. No. 3,867,806.

Yet another way of packaging contained products is by placing a top and bottom cover sheet on the product load and wrapping the products with a web of stretched plastic film to unitize the load. Thus, four sides of the load are placed under a containment force while the ends are not under a containment force.

The elasticity of stretched plastic film holds the product of the load under more tension than either shrink wrap of kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application.

The use of wrapping machinery to wrap stretched film around a load is well known is the art. Four types of stretch wrapping apparatus are commonly used in the packaging industry and these types are generally described as spiral rotary machines, full web rotary machines, pass through machines, and circular rotating machines. These machines have typically used top and bottom covers to provide for complete enclosure of the load.

Several load enclosure apparatuses are known which employ a spiral wrap. U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap. A rotating wheel forms the stuffed casing into twisted links.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting end, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern.

A full web rotary machine which can use a top and bottom sheet to form an enclosed packaged load is shown by U.S. Pat. No. 3,867,806.

A typical disclosure of a load enclosure in pass through wrapping is found in U.S. Pat. No. 3,640,048 which shows that film may be applied to the top and bottom of the pallet load prior to the wrapping cycle when it is desired to cover all six surfaces of the pallet load with film.

A load enclosure performed with a circular rotating machine is typified by U.S. Pat. No. 4,050,220. This patent discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the sides of the load. Further developments of circular rotary wrapping apparatus are disclosed in U.S. Pat. Nos. 4,110,957 and 4,178,734.

Commercial circular rotating wrapping machines are presently manufactured by Lantech, Inc., under the trademark LANRINGER and are provided with wrapping ring inner diameters of 36 inches, 54 inches, 72 inches, and 84 inches. In differentiating between the various circular rotating wrapping machines manufactured by Lantech, Inc., the manual model has the designation SR; the full web models have the designation SVR and SAVR; the spiral models have the designation SVSR and SAVSR, and the continuous wrap or bundler models have the model designation SVCR and SAVCR.

The present invention allows large loads to be wrapped on all sides so that a rectangular-shaped load will be wrapped on six sides with all sides being enclosed and held under a compressive force. This eliminates the need for costly top and bottom cover sheets along with the man hours or costly equipment needed to place the cover sheets on the load.

In addition, by stretching the continuous spiral wrap, the portion of the spiral wrap between the loads assumes a smaller diameter or enclosed cross-sectional area than that of the load due to the plastic film attempting to return to its original memory position. This smaller area allows the wrap to be more easily guided so that it can be sealed and severed.

The present invention overcomes problems in existing apparatus by utilizing a conveyor assembly which transports the stretched film web at the same speed as the load which is being carried through the dispensing area, thus providing a stronger wrap and eliminating disorientation, film tearing, product abrasion, and friction problems inherent in the prior art. Thus, there is not as much need to change the size of support tongues to support different weights and lengths of loads, or to make sure that there is sufficient space to hold the film from the film ring to cover the angle formed between the product and the stationary ring. As the loads are wrapped and carried into the sealing and cutting mechanism, the trailing end of each package is sealed and severed from the continuous web enclosing the load with a six sided wrap providing compression forces on each side. Simultaneously with the sealing and severing of the trailing end of the load wrap, the leading end of the following load wrap is formed.

SUMMARY OF THE INVENTION

The present invention generally comprises a novel apparatus for making a wrapped, enclosed unitary package. In the apparatus, a series of loads each containing a plurality of units is fed into a rotating wrapping apparatus having a film web stretching mechanism and film dispensing mechanism which covers the load with a plurality of layers of stretched film to form a unitary package. Each load, as it is fed into the rotating wrapping apparatus, is carried through a wrapping station by a conveyor assembly having an upper conveyor which carries the load in a downstream direction and a lower conveyor mounted under the load carrying conveyor and driven by the upper conveyor. The lower belt portion of the endless belt of the lower conveyor travels at the same speed and in the same direction as the upper belt portion of the endless belt of the load carrying conveyor so that stretched film wrapped around the load and conveyor assembly is carried by the lower conveyor at the same speed and in the same direction as the load is carried by the upper conveyor. The wrapped load is transported to a take-off conveyor spaced from the conveyor assembly allowing the wrap to be transported off of the conveyor assembly to assume a memory position around the load. After each load is wrapped in a continuous spiral mode, the conveyor assembly is stopped and the spiral film web located between the loads is guided by guide members of the sealing and cutting mechanism into a small sealing area where the film web is clamped together, sonically sealed, and severed to form an enclosed packaged load which is placed under containment forces.

Although the invention is set forth in the claims, the invention itself may be better understood by referring to the following description taken in connection with the accompanying drawings forming a part hereof, in which like reference numerals refer to like parts throughout the several views.

BRIEF DESCRIPTION OF THE DRAWINGS

FIG. 5 is an enlarged side elevational view of the guide members of the sealing and cutting mechanism shown in FIG. 4 in a partially closed condition engaging the spiral web wrap between loads;

FIG. 6 is a sequential view of the guide members of FIG. 5 in a closed position holding the film web for sealing and cutting;

FIG. 11 is an exploded side elevational view of sealing and clamp bars representing an alternate heat sealing embodiment;

FIG. 12 is a front elevational view of the sealing bar shown in FIG. 11;

FIG. 13 is an enlarged plan view of alternate clamp and seal surfaces which can be used with the clamp and seal bars of FIG. 11;

FIG. 14 is an enlarged plan view of yet another embodiment of clamp and seal surfaces which can be used with the clamp and seal bars of FIG. 12;

DETAILED DESCRIPTION OF THE DRAWINGS

Figure 1:
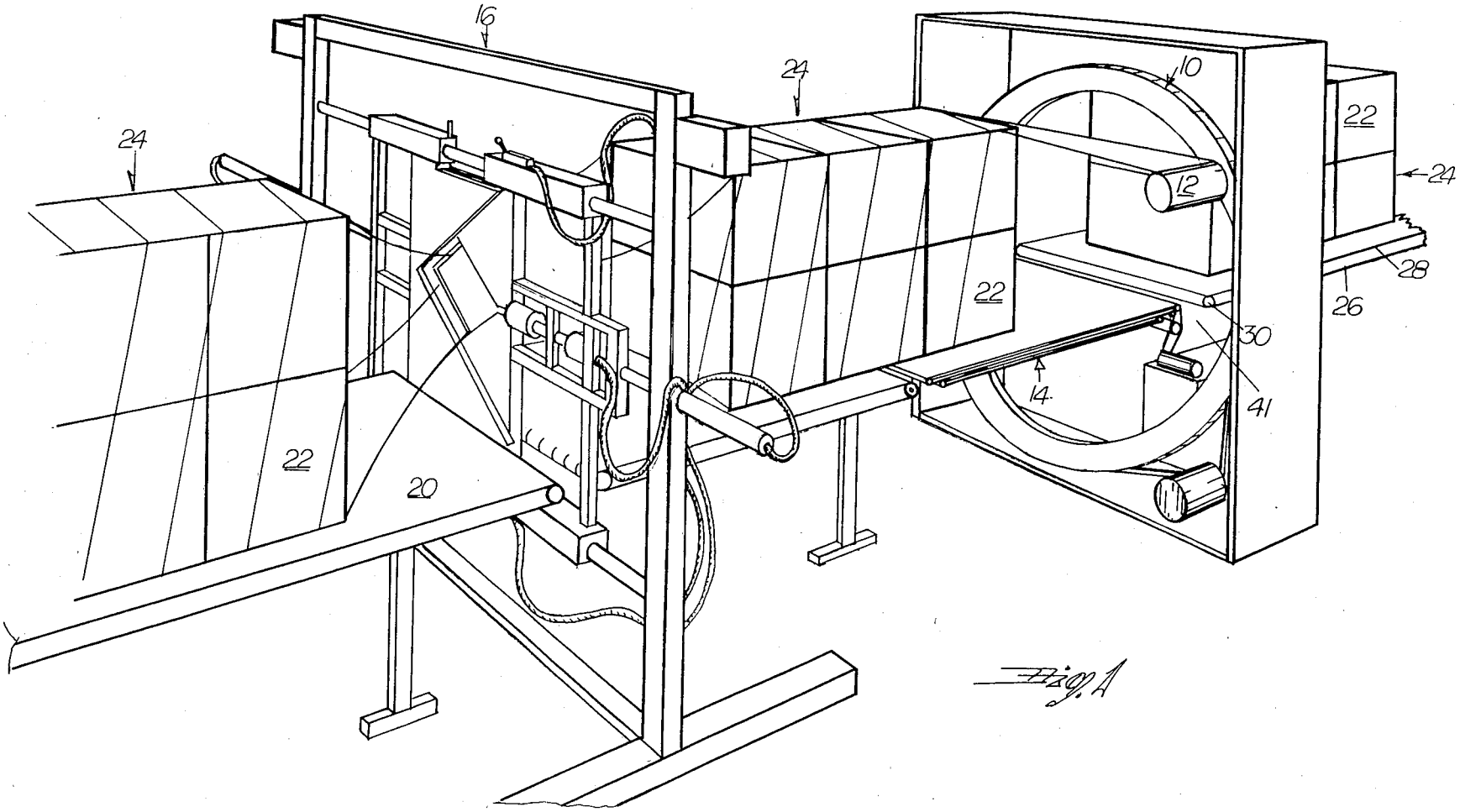
FIG. 1 discloses a perspective view of the inventive apparatus.

The preferred embodiment and best mode of the present invention as disclosed in FIGS. 1 through 10 shows a ring wrapping apparatus 10 with a film dispensing mechanism 12, a wrapping conveyor assembly 14, a sealing and cutting mechanism 16 with a weld control 18 and a take-off conveyor 20.

As shown in FIG. 1, a plurality of cartons 22 forming a load 24 have been loaded in a stacked relationship on conveyor assembly 14 by either an infeed conveyor, manual or mechanical means.

The aforementioned infeed conveyor can be in the form of an endless belt or can take the form of hydraulic or pneumatic pushing device (not shown) which can be used to engage each load 24 with a platen to push the load into the wrapping area.

If an infeed conveyor 26 is used, a conveyor belt 28 as seen in FIG. 1 is mounted on rollers 30 which are rotatably journalled by suitable bearing means in brackets which are secured to a frame support (not shown). The loads 24 are carried into a wrapping station 41 comprising a wrapping ring 10, a film dispensing mechanism 12, and a wrapping conveyor assembly 14.

Figure 2:
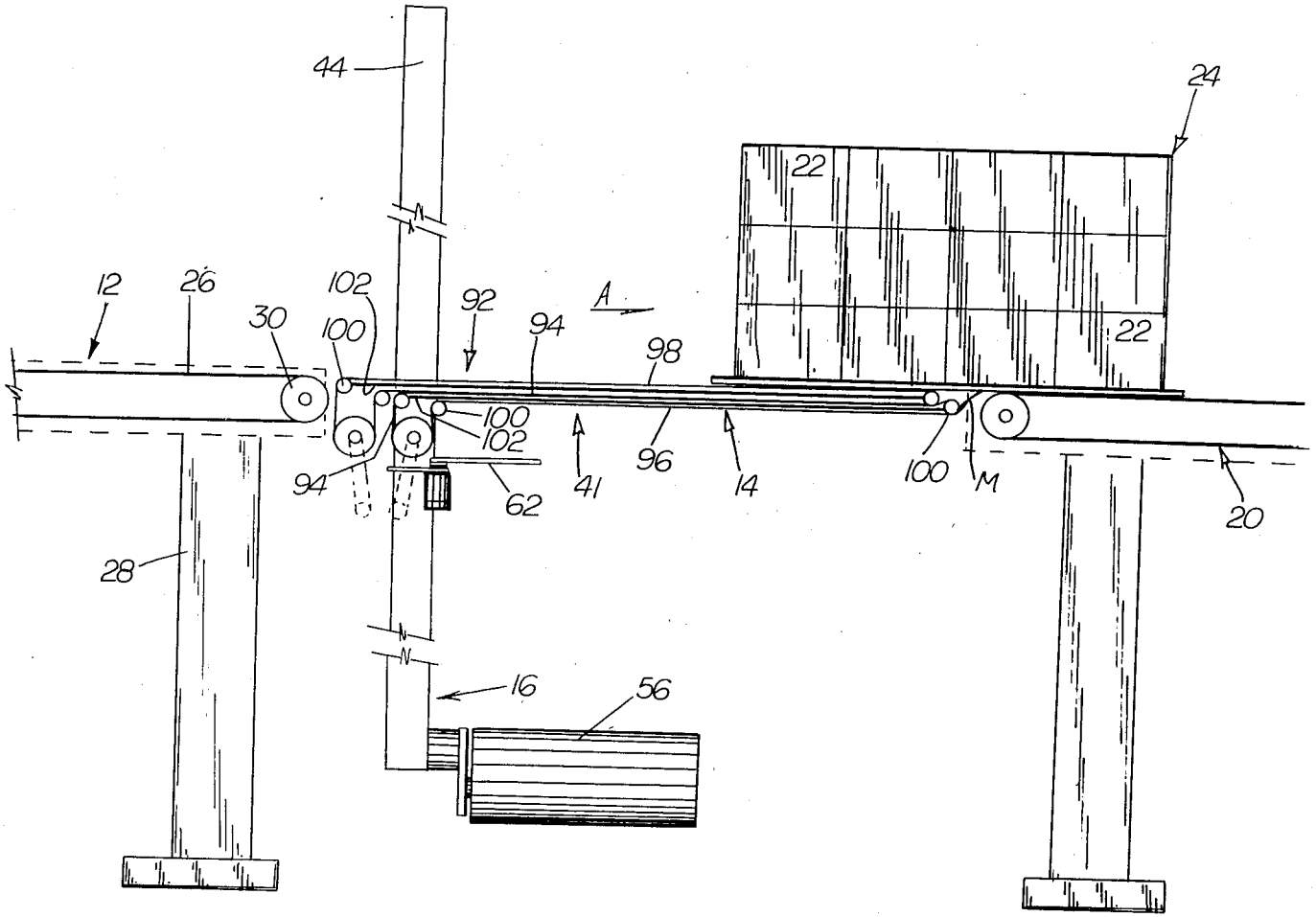
FIG. 2 is an enlarged rear elevational view of the ring wrapping apparatus and conveyor assembly as shown in FIG. 1.

The preferred wrapping apparatus 10 as shown in FIG. 2 comprises a frame 42 on which a steel "donut" or ring-shaped film support member 44 is rotatably mounted and supported in a rotating plane by guide rollers 46. If desired, the film support member can be constructed of aluminum. A plurality of guide rollers 46 project inward from the frame 42 on arms 47 and mounting plates 48 to engage the ring-shaped member 44 so that it can be driven in a pre-determined path. A friction drive wheel 49 is positioned adjacent the ring member 44 at its base and engages the member 44 to rotate the member 44 within the guide wheel rolling area. The friction drive wheel 49 is driven by a motor 50 having a shaft which is suitably connected with a drive reducer 52. A material roll dispensing shaft 54 is rotatably secured to the ring member 44 for rotation on its axis and is adapted to receive and hold a roll of film material 56.

Typical films which can be used in the stretch wrapping apparatus are EVA copolymer films with a high EVA content such as the films manufactured by Consolidated Thermoplastics "RS-50", Bemis "Super-Tough", and PPD "Stay-Tight" films. PVC films such as Borden Resinite "OS-26" can be used along with premium films such as Mobil-X, Presto Premium, and St. Regis which utilize a low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the load as well as providing a strong seal when properly heat sealed.

It should be noted that film, film material and film web are used interchangeably throughout the specification.

In the preferred braking assembly used with the wrapping apparatus 10, a film roll friction brake mechanism 59 is mounted to the ring-shaped member 44. The brake mechanism 59 engages the surface of the film roll 56 with a roller member 60 rotatably mounted to support arm 64 to maintain constant tension on the film material. This constant tension allows the film web to cover the load with the desired degree of stretch provided on the film. The leading edge 57 of the web of stretchable material 58 is withdrawn from the roll 56 without tension and is placed in a rotating clamp assembly 62 adjacent the initial load before tension is applied. However, if desired, the leading edge can be placed under initial tension.

The brake mechanism 59 controls the force of the arm 64 and its associated roller member 60 in engagement with the roll 56 accomplishing the braking process. The roller member 60 is constantly urged against the film roll 56 with a controlled force to provide a constant tension on the film roll and stretch the film 58 as it is being wrapped around the load 24.

Figure 15:
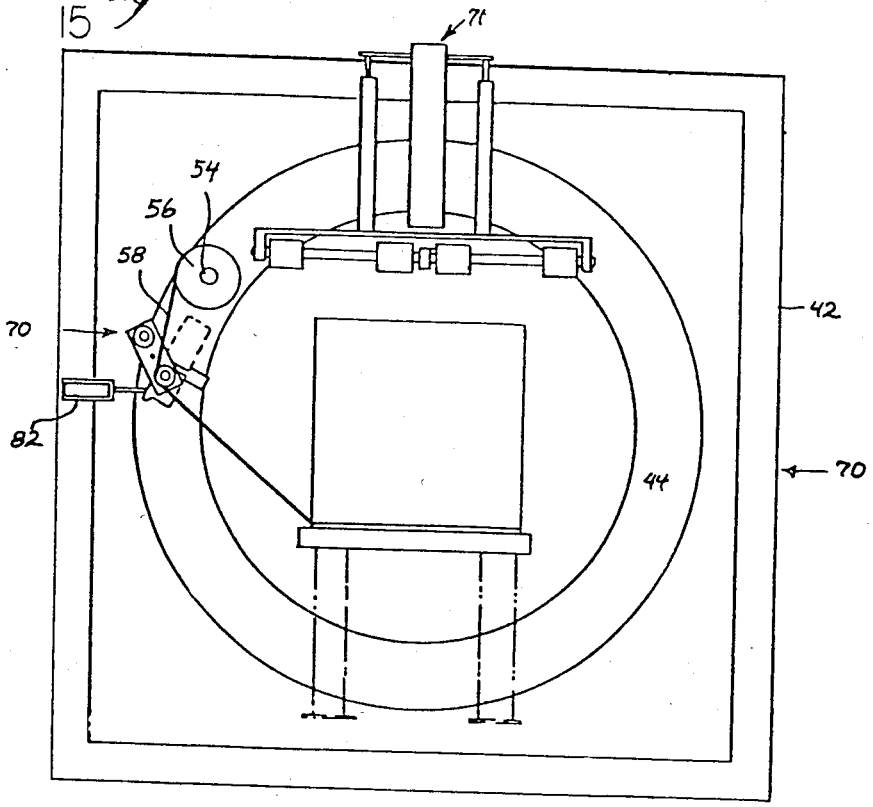
FIG. 15 is a rear elevational view of the invention with an alternate web stretching embodiment.
Figure 16:
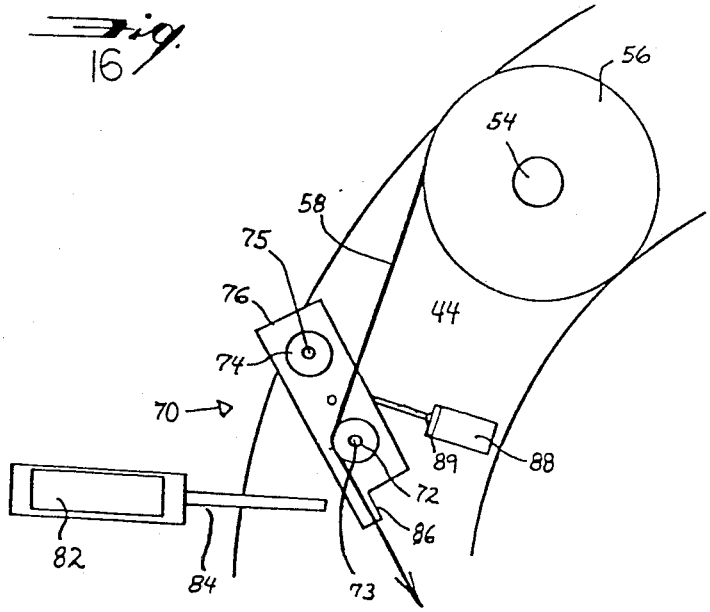
FIG. 16 is an enlarged elevational view of the alternate web stretching embodiment shown in FIG. 15.
Figure 17:
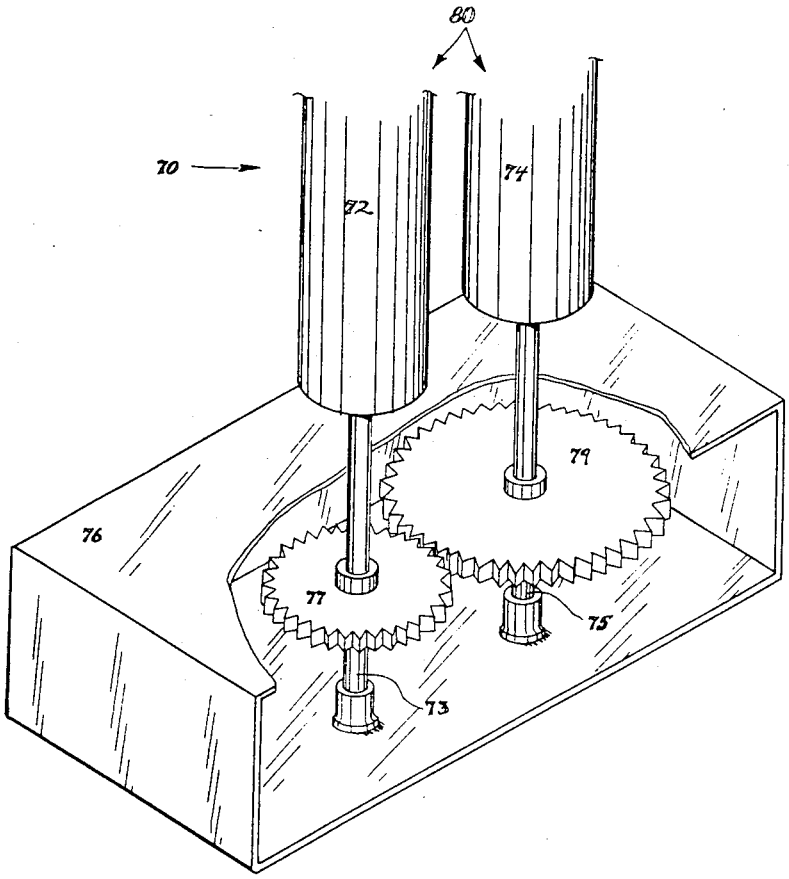
FIG. 17 is a perspective broken away view of a gear assembly used in the film web stretching embodiment.

An alternate film stretching embodiment as shown in FIGS. 15 through 17 can be used to stretch the film web. In this embodiment the film web is passed through a pre-stretching assembly 70 and is tucked or fastened underneath the load as shown in FIG. 15 or held in clamp assembly 62. The pre-stretching mechanism 70 comprises connected roller members 72 and 74 which are rotatably mounted on respective shafts 73 and 75 which are in turn journalled into a housing 76. The housing 76 is rotatably mounted by means of a pivot assembly (not shown) to the ring member 44. The rollers 72 and 74 are connected together by gears 77 and 79 as shown in FIG. 17, which mesh together and are driven as the film web engages the rubber roller surfaces driving the rollers. The gears 77 and 79 operate so that the film web will drive the downstream roller 72 at a faster rate than the upstream roller 74 causing the film to be stretched in a narrow space 80 between the two rollers. The pre-stretching mechanism 70 is pivotable so that the film may be threaded through the mechanism and wrapped around the load 24 in a substantially unelongated condition until such time as the first corner of the load is covered with unstretched film.

Before the start of the film wrap, a pneumatic cylinder 82 mounted to frame 42 is activated causing piston rod 84 to extend outward and engage the cam portion 86 of housing 76, pushing the cam portion inward to the center of the ring so that roller member 74 does not engage the film web. Since the connected roller members do not both engage the film web, the film web can be easily threaded through the stretching mechanism and tucked or clamped under the load 24. After the leading edge 57 of the film has been placed under the load, the wrap cycle is activated by the operator and the piston rod 84 is retracted into the pneumatic cylinder away from the housing 76. A coil spring (not shown) engages the housing and is connected to a shaft which is rotatably mounted to constantly urge the roller 74 section of housing 76 toward the center of the ring member 44 so that both roller members 72 and 74 engage the film web. A fluid damper 88 of a type well-known in the art is secured to the ring member 44 and engages the side of the housing 76 to prevent the roller member 74 from engaging the film web. The piston 89 of the damper is provided with a suitable orifice allowing the force of the coil spring to gradually push the piston rod and its associated piston rearward at a pre-determined speed allowing an appropriate amount of unelongated film web to be rotated around the load.

Figure 3:
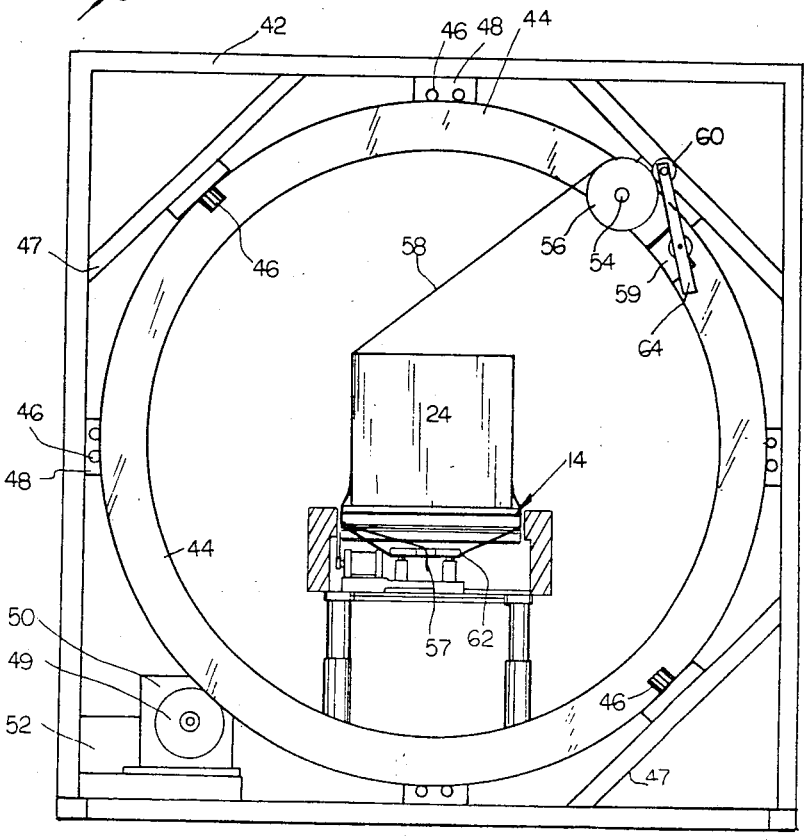
FIG. 3 discloses an enlarged reversed side elevational view of the conveyor assembly as shown in FIG. 1.
Figure 4:
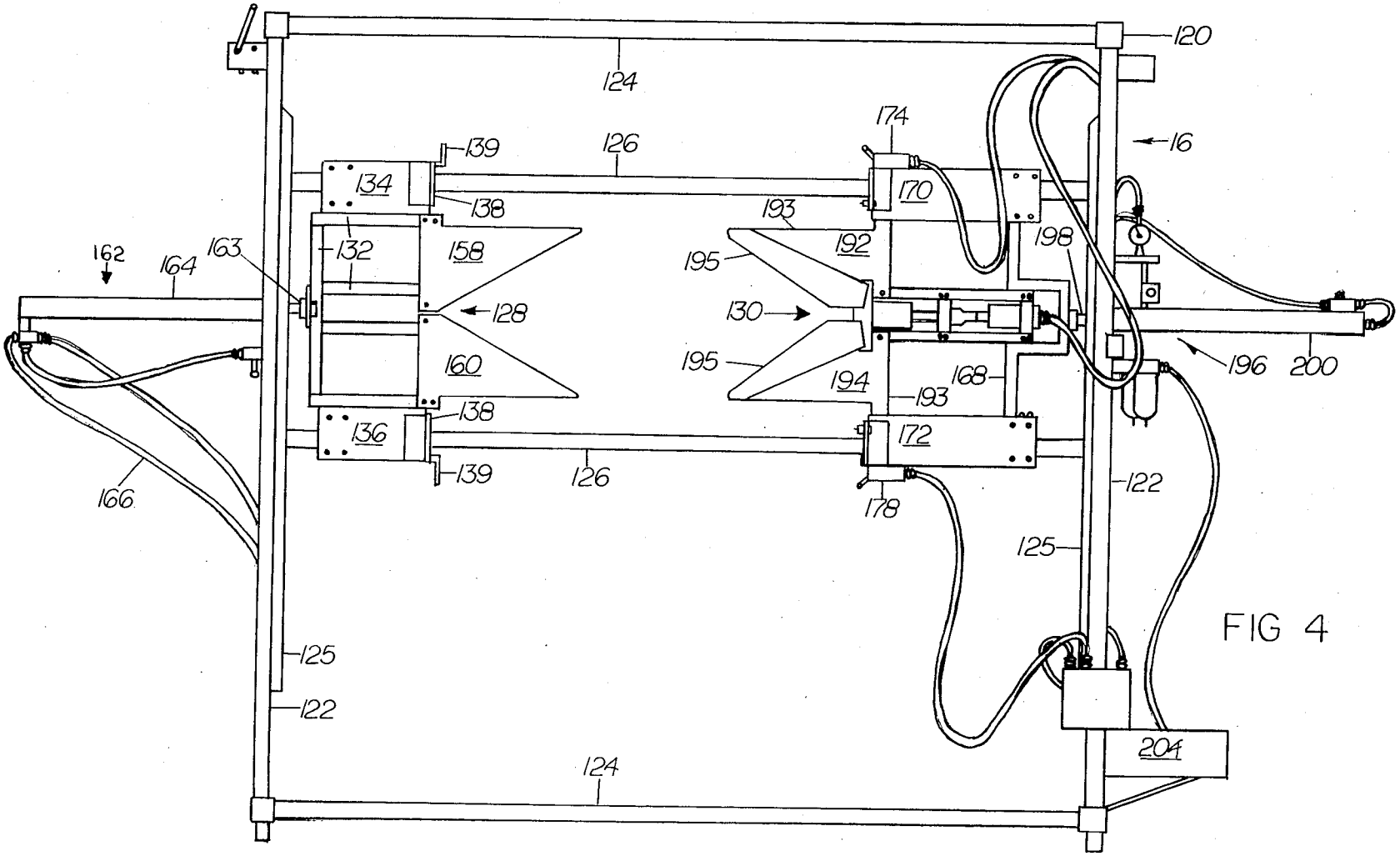
FIG. 4 is an enlarged side elevational view of the sealing and cutting mechanism shown in FIG. 1.

The wrapping conveyor assembly 14 as best seen in FIGS. 1 and 3 comprises two stacked conveyors 92 and 94. These conveyors are standard plate-type conveyors well-known in the art comprising driven endless belts 96 and 98 mounted on a plurality of rollers 100. The rollers are supported by plates 102 secured in turn to a frame member (not shown) which holds the rollers in a rotatable position. The endless belt 98 is driven so that the upper portion of the belt is rotated in a direction A shown by the arrow in FIG. 3. Belt 98 is driven by a motor assembly 104 shown in FIG. 3 which is connected by gear means 106 and linkage 108 in the form of a chain or belt to drive the conveyor. Both belts 96 and 98 are textured so that they have a high coefficient of friction. The lower segment of conveyor belt 98 travels upstream engaging and driving the upper segment of belt 96 upstream. Thus, the upper segment of conveyor belt 98 and the lower segment of conveyor belt 96 travels downstream.

This construction allows a web of film to be wrapped around a load 24 and the conveyor assembly 14 with both the load and wrap being carried by the conveyor assembly in the same direction. In operation, the conveyor assembly 14 and wrapping ring 10 are stopped while sealing is accomplished downstream by the sealing and cutting mechanism 16. When the load encounters the take-off conveyor 20 as shown in FIG. 1 the elongated stretched spiral web coming off of the end of the conveyor assembly assumes its memory position M against the load in the space between the conveyor assembly 14 and take-off conveyor 20, and forms an hourglass-like appearance when viewed in two load sections.

The preferred embodiment of the cutting and sealing mechanism 16 is best shown in FIGS. 4–10 of the drawings. The cutting and sealing mechanism 16 comprises a frame 120 constructed of upright support member 122, cross-support members 124 suitably secured or mounted to the upright support members, support plates 125 secured to the upright support member 122 by bolting, welding or other suitable means, each support plate connecting two upright members and holding tubular slide members 126 mounted to the support plates 125.

An anvil assembly 128 is slideably mounted on upper and lower slide members 126 and is positioned opposite a horn assembly 130 mounted on the same slide members 126. The anvil assembly comprises a support frame 132 having an upper slide support member 134 secured thereto which is mounted on the upper slide member 126 and a lower slide support member 136 which is secured to the lower portion of support frame 132 and is slideably mounted to a lower slide member 126. Each of the slide support members 134 and 136 are constructed with a base plate 135 and a two piece sleeve (not shown), one piece being secured to the base plate, the other piece being removably mounted to the first piece. The two piece sleeve, which is of a standard construction, forms a throughgoing bore which receives slide member 126. A stop plate 138 is secured to the base plate and extends outward therefrom, each plate being "L" shaped and adapted to engage stops 176 and 180. "L" shaped limit switch plates 139 are also secured to base plate 135 and are adapted to engage limit switches 174 and 178.

Figure 7:
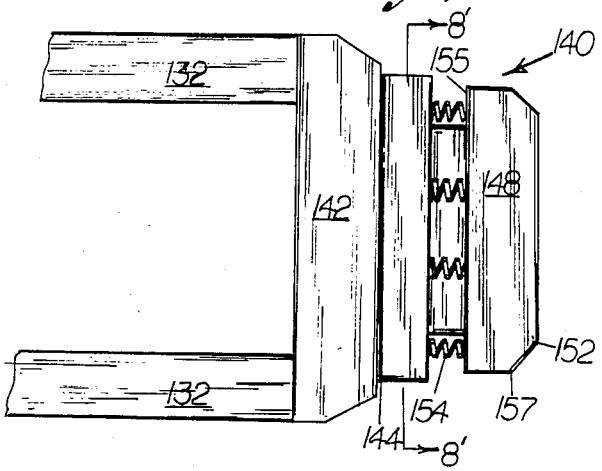
FIG. 7 is an enlarged side elevational view of the anvil mechanism mounted in the left anvil assembly of FIG. 4.
Figure 8:
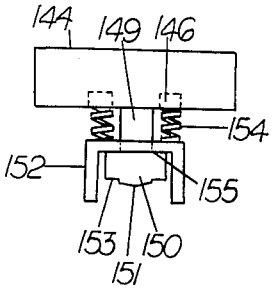
FIG. 8 is a top plan view of a portion of the anvil mechanism taken along line 8'8' of FIG. 7.
Figure 9:
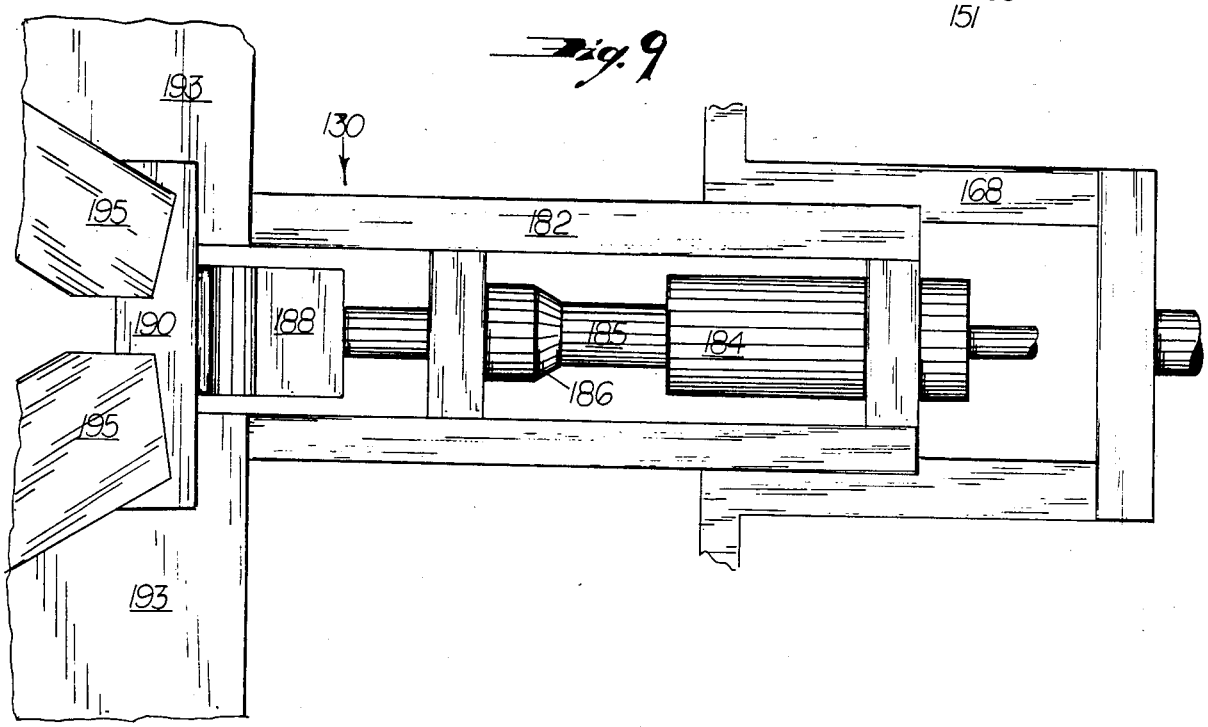
FIG. 9 is an enlarged side view of the horn mechanism mounted in the horn assembly of FIG. 4.

An anvil mechanism 140 as is best seen in FIGS. 7 and 8 is mounted to support frame 132. The anvil mechanism 140 comprises a support plate 142 secured to the center members of support frame 132 and a seat member 144 defining spring seats 146 secured to support plate 142 by bolting, screws or other suitable fastening means. An anvil member 148 is mounted to the seat member 144. The anvil member 148 is provided with a body 149 formed with a head 150 having a crest 151 and a slope of 15° on either side of the crest. A step 153 of about 1/16 of an inch is cut into the head on the distal side of the slope or incline. The rear of the head defines a planar rear surface 155. The planar rear surface 155 forms a stop for a spring loaded clamp plate 152 having a substantially "U" shaped cross-section as seen in FIG. 8. The spring loaded clamp plate 152 is provided with bevelled end sections 157. A plurality of springs 154 are respectively seated in spring seats 146 formed in seat member 144 with the other ends of the springs being secured to the back of clamp plate 152 to urge the clamp plate 152 outward until it abuts against the rear planar surface 155 of the anvil head. The clamp plate 152 is urged backward by the action of the clamp plate of the horn assembly 130 as will be further described in the operation of the invention.

As can be seen in FIGS. 5 and 6, an upper trapezoidally-shaped guide assembly 158 comprised of two identically shaped parallel plates 159 is removably mounted to the support frame 132 and covers a section of the anvil mechanism 140. A lower trapezoidally-shaped guide assembly 160 comprised to two identically shaped parallel plates 161 is mounted in the same manner as assembly 158 to the support frame 132 and also covers the anvil mechanism 140. The guide assemblies 158 and 160 serve to engage and guide the spiral film web as shown in FIGS. 5 and 6 so that a collected portion of the film web can be held against the crest 151 of the anvil head 150 to provide better sealing and cutting. The crest and inclined side allow a weld on both sides with a cut off at the point of the crest. Returning to FIG. 4, a pneumatic assembly 162 is secured to support plate 125 and is comprised of a piston member 163 which is secured to the support frame 132 and reciprocally mounted in cylinder housing 164. The housing 164 extends away from the support frame 132 to the outside of the frame 120. The cylinder housing 164 is connected by standard well-known state of the art means to a pneumatic hose assembly 166 leading to a reservoir or source of pressurized fluid. Thus, the pneumatic assembly 162 is adapted to drive the anvil assembly 128 in a well known manner along support slide members 126 until it engages with the horn assembly 130 as will be further described.

The horn assembly 130 as shown in FIGS. 4–6 and 9, comprises a support frame 168, an upper slide support member 170 removeably secured to said support frame and slideably mounted on upper slide member 126, and a lower slide support member 172 removably secured to support frame 168 and slideably mounted on the lower slide member 126. Both members 170 and 172 are constructed with a sleeve similar to that previously described for members 134 and 136. Two sleeves are mounted on each end of members 170 and 172. A top limit switch 174 is mounted to the base plate of upper slide support member 170 and is adapted to engage the upper "L" shaped limit switch plate 139. This top limit switch acts as a safety switch for the welding mechanism. A stop 176 is screwed to stop plate 177 which is in turn mounted to the upper slide support member base plate. A lower limit switch 178 mounted to the base plate of lower slide support member 172 engages a lower stop plate 139 to start the sonic weld time function as will be further discussed. A stop 180 is mounted to plate 181 in the same manner as stop 176 to adjust the minimum distance that the horn and anvil can come together. A horn housing 182 is mounted to the support frame 168 and holds in operative relationship a converter 184 which converts the electrical current from a power source to a mechanical vibration emanating from end 185. A booster 186 engages the end of the converter and increases or decreases the was amplitude coming off of the converter end 185. The booster preferably has a 2.5:1 mechanical relationship and increases amplitude so that a 1 mil vibration can be changed to a $2\frac{1}{2}$ mil amplitude. A titanium horn 188 is operatively connected to the booster 186, and the titanium horn vibrates back and forth in a horizontal direction at 20,000 cycles per second. A pair of clamp members 190 are positioned adjacent the horn 188 to engage the clamp plate 152 of the anvil and hold the film web in a clamped position. If the film is not clamped when it is heated, it will come apart in its molten sealing state. An upper film guide assembly 192 is removably mounted to the support frame 168 and a lower film guide 194 is also removably mounted to the support frame 168 to provide a guide area into which the film web is guided until the film web is positioned within a prescribed weld area 300. Both guide assemblies are comprised of trapezoidal shaped plate members 193 and outer plate spacer members 195. The horn assembly is driven inward by a pneumatic cylinder assembly 196 having a piston 198 which is secured to the outer side of the support frame 168, and a cylinder housing 200 which is secured to plate 125 of the frame.

Figure 10:
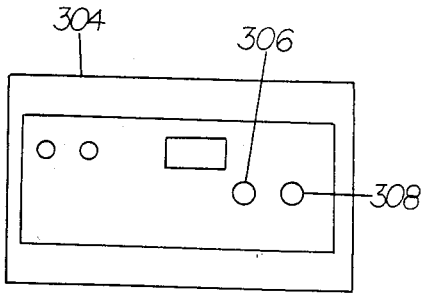
FIG. 10 is an enlarged front elevational view of the control box shown in FIG. 4.

As seen in FIG. 10, a power supply which in the present case is a Branson 184 P power supply, a standard off-the-shelf mechanism supplies power to the limit switch and welding components through the use of a control box 304 having a weld dial 306 which sets the weld time to vibrate the film to create heat to weld the film and a cooling dial 308 which sets the cooling time before release of the clamp jaws. The weld time is the amount of time that it takes to vibrate the film enough to create necessary sealing heat. The cooling time is the time needed to maintain clamping position to hold the film until it is cooled enough not to break the seal.

In operation of the mechanism, a space between two packages is sensed by standard state-of-the-art sensing means such as a photoelectric sensor, infra sensor, etc., and the anvil assembly 128 and horn assembly 130 are propelled inward by their respective pneumatic assemblies 162 and 196 so that the inwardly inclined surfaces of the guide plates cause the spiral wrapped band of film to be forced or guided into a progressively smaller space until the film web is forced into a collected configuration within weld area 300 preferably having a $1\frac{1}{2}$ inch width. The anvil 148 inside the guides 158 and 169 remains stationary as the spring loaded clamp plate 152 is compressed inward by horn clamp members 190 against seat member 144. No welding is initiated until contact occurs between the horn 188 and the crest 151 of the anvil 148. The contact of the horn with the anvil causes the film web to be sealed and cut due to the vibration of the horn forming a heat seal. Both the horn and anvil remain cold so that as soon as a $\frac{1}{2}$ second welding time passes, heat conduction between the hot weld and horn and anvil dissipates the heat into the horn and anvil, allowing the seal to become hard and strong. The clamps are then released and the apparatus opens.

The weld or seal which is obtained is thus a function of three factors:

1. The amount of air pressure on the weld decreasing the amount of time to make the weld.
2. The amplitude determined by the type of booster used.
3. The duration of the booster or dwell period.

Thus, it can be seen that the amplitude can be increased and dwell time lessened accordingly so that an appropriate weld is made.

Alternative embodiments of the heat sealing mechanism can be used in place of the sonic welding mechanisms. These utilize the same basic structure as used in the sonic mechanism with the difference being that the anvil and horn assemblies are removed and a heat seal bar 200 and a cold seal bar 210 are inserted in their place.

In the heat sealing embodiment as shown in FIGS. 11 and 14 a hot bar 200 is provided with Bakelite strips 202. The strips are used to keep the film web from touching the hot bar 200 until it comes into final sealing contact when the cold bar 210 engages the film web and clamps it against the hot bar. The hot bar 200 is formed with a point or crown 204 which causes the cutting to take place. A coating of teflon material 206 is placed over the outer surface of the hot bar 200 and cold bar 210 to prevent adhering of plastic material to the surfaces of the bars during the sealing process. The cold bar which is viewed as the right bar in FIG. 11 does not need the protective Bakelite strips 204 and is provided with a planar surface 212. The left bar or hot bar has a crown or linear crest, and because of the planar surface of the cold bar very little alignment is required when the axis of the two bars comes together. The sealing bars are only in contact for a half a second or less to provide the film seal and severing.

In another alternate embodiment as shown in FIGS. 12 and 13 the cold bar 220 has a "U" shaped channel 222 formed in its surface in which is positioned a nichrome wire 224 which runs down between the legs of the "U" shaped channel. Both ends of the wire 224 are secured to springs 226 which are in turn mounted to insulation members 228 secured to a plate 230 on which the cold bar 220 is mounted. The springs take up slack when the nichrome wire expands so that the nichrome wire is kept tight and maintains its position within the channel 222. The purpose of heating both bars in this embodiment is to add more heat at the cut-off point to make a more reliable cut-off. The crown 204 of the hot bar 200 hits the nichrome wire which is only heated in the cold bar at the time of contact. Both the hot bar 200 and cold bar 210 in the first embodiment or the hot bar 200 and cold bar 220 of the second embodiment are adapted to be removably mounted to a suitable structure so that they can operate in place of the horn and anvil embodiment.

It should be noted that various components of the wrapping and sealing apparatus can be interchangeable without departing from the scope of the invention. In the foregoing description, the invention has been described with reference to a particular preferred embodiment, although it is to be understood that the specific details shown are merely illustrative, and the invention may be carried out in other ways without departing from the true spirit and scope of the following claims.

What is claimed is:

1. A wrapping apparatus for wrapping a plurality of loads and separating the loads into individually enclosed packages comprising a wrapping means, said wrapping means comprising a frame, a ring rotatably mounted in said frame, means to rotate said ring, film dispensing means mounted on said ring and film stretching means mounted on said ring to stretch film dispensed by said film dispensing means, a conveyor means positioned within a wrapping area of said wrapping means, said conveyor means being adapted to carry a plurality of loads through said wrapping area so that said wrapping means dispenses a continuously stretched spiral wrapped web of film around said loads, and a cutting and sealing assembly positioned downstream of said conveyor means, said cutting and sealing assembly comprising a cutting frame, a plurality of opposing film guide mechanisms reciprocally mounted on said cutting frame, each of said film guide mechanisms comprising a support frame, a plurality of angled members mounted on said support frame, said angled members defining a throat therebetween, means mounted to each of said film guide mechanisms to converge said guide mechanisms along said cutting frame to engage and confine said continuously stretched spiral wrapped web of film in said throat between successive loads, film clamping and seating means mounted in one of said guide mechanisms and heat generation means mounted to another one of said guide mechanisms opposite said clamping and seating means to engage said clamping and seating means to sever and seal the film wrap confined in said throat to enclose a load.

2. A wrapping apparatus for wrapping a plurality of spaced loads and separating the loads into individually enclosed packages comprising a wrapping means, said wrapping means comprising film web stretching means mounted to said wrapping means to stretch film web dispensed from said wrapping means, a powered conveyor positioned within a wrapping area of said wrapping means to carry a plurality of loads through said wrapping area and transport the film web deposited by said wrapping means around each said load and said conveyor means so that a continuous spiral wrap of film web is placed around said loads, and a cutting and sealing assembly positioned downstream of said powered conveyor, said cutting and sealing assembly comprising a frame, a plurality of film guide means reciprocally mounted on said frame, each of said film guide means comprising a support frame, a plurality of angled members mounted on said support frame, said angled members being angularly inclined with respect to each other to form a throat of decreasing cross-section, slide means mounted to each said film guide means allowing said film guide means to be reciprocally moved of said frame, means mounted to each said film guide means to reciprocally move said film guide means along said frame toward each other so that the angled members engage said continuous spiral wrap of film web in a space between successive loads and carry said film web into a small aperture defined by the distal ends of the throats of adjacent film guide means forming a sealing area, film clamp means mounted in one of said film guide means and heat generation means mounted in another one of said film guide means, said clamp means and said heat generation means acting to sever and seal the film web in said sealing area to form the sealed trailing end of one packaged load and the sealed forward end of the following packaged load.

3. Wrapping apparatus as claimed in claim 2, wherein the film clamp means of said one film guide means comprises anvil means and the heat generation means of said another film guide means is a horn assembly.

4. Wrapping apparatus as claimed in claim 3, wherein said horn assembly comprises a horn housing, a converter mounted in said horn housing, said converter being connected to a power source which transmits an electrical current to said converter, said converter converting said electrical current into a mechanical vibration, a booster engaging an end of said converter to change the amplitude of the wave form coming off of said converter and a horn member engaging said booster, said horn member being vibrated back and forth to induce friction in the plastic film causing the film to become molten allowing the film web to be sealed and severed.

5. Wrapping apparatus as claimed in claim 3, wherein said anvil means comprises a body and a head, said head defining a crest.

6. Wrapping apparatus as claimed in claim 3, wherein said anvil means has a head defining a crest with inclined surfaces of approximately 15° extending from said crest and step means positioned on the sides of said inclined surfaces away from said crest.

7. Wrapping apparatus as claimed in claim 6, wherein said steps are approximately 1/16 of an inch in depth.

8. Wrapping apparatus as claimed in claim 3, including a clamping assembly mounted to said one film guide means, said clamping assembly comprising a spring biased clamp plate having a substantially U-shaped cross section, said clamp plate being urged outward by spring means engaging said clamp plate so that the base of the clamp plate engages a rear portion of the anvil means and the legs of the clamp plate extend past the forward edge of the anvil means.

9. Wrapping apparatus as claimed in claim 2, wherein said film clamp means of said one film guide means is a plurality of clamp plates secured to a horn housing.

10. Wrapping apparatus as claimed in claim 2, wherein said heat generation means is a heated sealing bar.

11. Wrapping apparatus as claimed in claim 2, wherein said heat generation means is a heated sealing bar provided with a plurality of insulated strips mounted thereto, said insulated strips extending past the edge of the heated sealing bar to hold the film web away from the heated surface until the film web is transported on to the heated surface.

12. Wrapping apparatus as claimed in claim 10, wherein said heated sealing bar has a curved outer surface and defines a crown.

13. Wrapping apparatus as claimed in claim 2, wherein said film clamp means on said one film guide means comprises a cold bar having a planar outer surface.

14. Wrapping apparatus as claimed in claim 2, wherein said film clamp means is a substantially linear member which defines a channel therein and has a nichrome wire positioned in said channel and supported by insulator means mounted to said linear member.

15. Wrapping apparatus as claimed in claim 14, wherein said nichrome wire is provided with spring means on each end which are mounted to said insulator means to adjust said nichrome wire within said channel when said nichrome wire is heated and cooled.

16. A wrapping apparatus for wrapping a plurality of substantially rectangular loads and separating the loads into individually wrapped, enclosed rectangular packages comprising a wrapping means, said wrapping means including film stretching means mounted to said wrapping means to stretch film dispensed from said wrapping means, powered conveyor means positioned within the wrapping area of said wrapping means adapted to carry a plurality of loads through said wrapping area and transport the film deposited by said wrapping means around said load and said conveyor means so that a continuous spiral wrap of film is placed around said loads, a cutting and sealing assembly positioned downstream of said conveyor means, means to stop said conveyor means so that a space between said loads is positioned within said cutting and sealing assembly, said cutting and sealing assembly comprising a frame, a plurality of guide mechanisms slideably mounted on said frame, each of said guide mechanisms comprising a support frame, a plurality of angled plate members mounted on said support frame, said angled plate members being positioned with respect to each other so that exterior edges of plate members form a funnel shape directing the continuous spiral wrap of film inward to occupy a progressively smaller space, an anvil assembly mounted to one of said guide mechanisms, said anvil assembly comprising a base plate, an anvil member mounted to said base plate, a spring biased clamp plate mounted to said base plate and around said anvil member so that said clamp plate is being urged outward by a spring means engaging said clamp plate with portions of said clamp plate extending past the forward edge of said anvil member, pneumatic means mounted to each of said guide mechanisms to reciprocally move said guide mechanisms along said frame toward each other so that the angled plate members engage said continuous spiral wrap of film and carry said wrap of film into a small area defined by the plate members of both guide mechanisms, film heating means mounted in the other said guide mechanisms opposite the anvil assembly of the said one guide mechanism, said heating means comprising a sonic means which converts electrical current into a mechanical vibration of suitable frequency to induce friction in the plastic film of the film web held between the heating means and anvil assembly to melt said wrap of film to be sealed and severed.

17. A wrapping apparatus as claimed in claim 16, wherein said anvil member has an extending head portion which defines the crest within inclined surfaces on either side extending from said crest and step means positioned on the opposite side of the inclined surfaces away from said crest.

18. Wrapping apparatus as claimed in claim 17, wherein said anvil head crest forms a linear configuration substantially parallel to the upright standards of the frame.

19. A wrapping apparatus for wrapping a plurality of spaced rectangular loads and separating the rectangular loads into individually enclosed rectangular packages held under compressive force comprising a wrapping means, said wrapping means including film stretching means mounted to said wrapping means to stretch film dispensed from said wrapping means, a powered conveyor positioned within the wrapping area of said wrapping means adapted to carry a plurality of loads through said wrapping area and transport the film deposited by said wrapping means around said load and said conveyor means so that a continuous spiral wrap film is placed around said loads, a cutting and sealing assembly positioned downstream of said powered conveyor, said cutting and sealing assembly comprising a frame, a plurality of guide mechanisms reciprocally mounted on said frame, each of said guide mechanisms comprising a support frame, a plurality of angled members mounted on said support frame, said angled members being angularly inclined with respect to each other to form a funnel directing the continuous spiral wrap film inward to occupy a progressively smaller space, a cold bar means mounted to one of said guide mechanisms and a hot bar means mounted to another of said guide mechanisms opposite from said cold bar means, said hot bar means being provided with means to supply heat thereto and being formed with an outer surface terminating in a crest segment which is substantially parallel to the axis of said cold bar means, pneumatic means mounted each of said guide mechanisms to reciprocally move said guide mechanisms along said frame toward each other so that the angled members engage said continuous spiral wrap film in a space between successive loads and carry said film into a small area defined by the closed members, said hot bar means when activated providing heat against the film held between it and the cold bar means to sever and seal the film forming a sealed trailing end of one packaged load and the sealed forward end of the following packaged load.

20. Wrapping apparatus as claimed in claim 19, wherein said hot bar means has a plurality of insulated spacer elements extending therefrom past the forward surface of said heated bar, said spacer elements serving to keep said film away from said heated surface until the cold bar means of the other guide mechanism engages and transports the film against the heated outer surface of the hot bar means.

21. Wrapping apparatus as claimed in claim 20, wherein said insulated spacer elements are a plurality of Bakelite strips.

22. Wrapping apparatus as claimed in claim 19, wherein said cold bar means defines a channel and comprises a base plate, a second channeled bar mounted on said base plate, a plurality of insulators mounted on said base plate and a nichrome wire mounted to said insulators and axially aligned within the channel of said second channeled bar, said nichrome wire being selectively heated to accelerate cutting of the film web at a predetermined time.

23. Wrapping apparatus as claimed in claim 22, including spring means connected to said nichrome wire and at least one of said insulator means to tension said nichrome wire within said channel of said second channeled bar when such nichrome wire is expanded during heating and contracted during cooling.

* * * * *